US009073203B2

(12) United States Patent
O'Hare

(10) Patent No.: US 9,073,203 B2
(45) Date of Patent: Jul. 7, 2015

(54) MARKING TOOL

(76) Inventor: Brendan Joseph O'Hare, Newry Down (GB)

( * ) Notice: Subject to any disclaimer, the term of this patent is extended or adjusted under 35 U.S.C. 154(b) by 205 days.

(21) Appl. No.: 13/768,173

(22) PCT Filed: Aug. 15, 2011

(86) PCT No.: PCT/GB2011/051542
§ 371 (c)(1),
(2), (4) Date: Feb. 15, 2013

(87) PCT Pub. No.: WO2012/022968
PCT Pub. Date: Feb. 23, 2012

(65) Prior Publication Data
US 2013/0160308 A1 Jun. 27, 2013

(30) Foreign Application Priority Data
Aug. 16, 2010 (GB) ..... 1013693.5

(51) Int. Cl.
*B25H 7/04* (2006.01)

(52) U.S. Cl.
CPC . *B25H 7/04* (2013.01); *B25H 7/045* (2013.01)

(58) Field of Classification Search
USPC ..... 33/32.1, 32.2, 41.1, 42, 194, 197, 574
See application file for complete search history.

(56) References Cited

U.S. PATENT DOCUMENTS

| | | | | |
|---|---|---|---|---|
| 1,392,710 | A | 10/1921 | Shong | |
| 8,096,056 | B1 * | 1/2012 | Murdock | 33/194 |
| 2003/0131486 | A1 * | 7/2003 | Wallace | 33/194 |
| 2005/0034244 | A1 | 2/2005 | McCreesh | |
| 2006/0162174 | A1 * | 7/2006 | Vick | 33/42 |
| 2007/0163130 | A1 * | 7/2007 | Kyoung-Soo | 33/42 |
| 2008/0276471 | A1 * | 11/2008 | Arne | 33/194 |

FOREIGN PATENT DOCUMENTS

| | | | |
|---|---|---|---|
| FR | 2871082 | A1 | 12/2005 |
| GB | 791635 | A | 3/1958 |

* cited by examiner

*Primary Examiner* — G. Bradley Bennett
(74) *Attorney, Agent, or Firm* — Sullivan & Worcester LLP

(57) ABSTRACT

A hand-holdable marking tool comprising a housing, a plate-like reference piece locatable against a surrounding frame; and a marking implement having a marking point movable to a pre-determined distance away from the reference piece. The hand-holdable marking tool may be a hand-holdable door marking tool (2) used against a door frame. The invention further provides a method of marking a door in comparison with a corresponding door frame.

18 Claims, 2 Drawing Sheets

MARKING TOOL

Figure 1A:
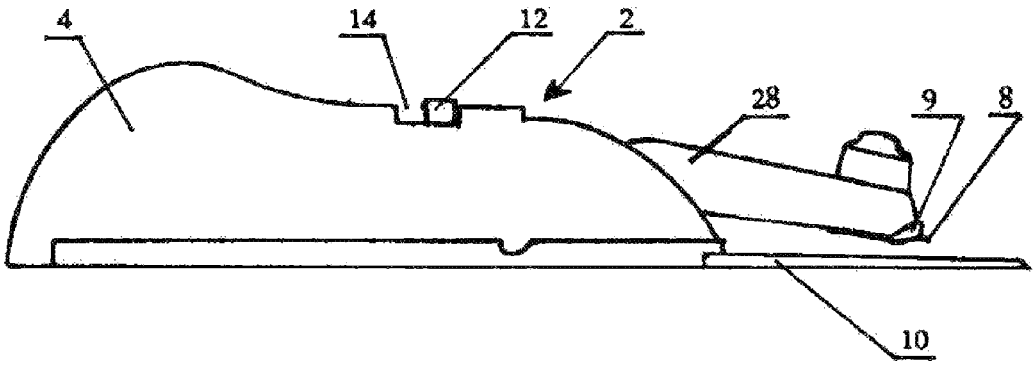

This application is a national stage of International Application No. PCT/GB2011/051542, filed Aug. 15, 2011, which claims priority to GB Patent Application No. 1013693.5, filed Aug. 16, 2010, the entire disclosure of which is herein expressly incorporated by reference.

The present invention relates to a tool being a hand-holdable door scribe to assist marking for the trimming of doors and the like in frames such as door frames.

Commonly, whilst a door can be provided having a regular size, generally with accurately made parallel sides, the door frame in and to which the door is to be located and hung is not as regular. Thus, many if not most doors require some amount and form of trimming to fit the irregularity of the door frame.

The trimming of doors prior to their hanging requires delicate and accurate location of the door within the door frame prior to marking or scribing the door for the required trim. As doors are typically heavy objects, this can either be a two-man job, or a one-man job requiring at least one hand to hold the door in position leaving only one hand free.

Generally it is desired to have a relatively accurate and regular gap between a door side and each part of the door frame, which gap can be different for different sides, usually different for the top and the sides. In many typical situations, the gap is desired to be at least 1 mm up to a few millimeters, more typically 2, 3 or 4 mm.

This gap is judged from the door frame, and must be marked or scribed on the door. At present, carpenters or fitters have to hold the door in place with wedges or have someone else hold it in place while they use both hands to mark the door, often with a hinge.

It is the object of the present invention to provide a tool for a single carpenter to hold the door in place and mark around the door.

Thus, according to one aspect of the present invention, there is provided a hand-holdable door marking tool comprising:

a housing;

a plate-like reference piece locatable against a door frame; and a marking implement having a marking point movable to a pre-determined distance away from the reference piece.

In this way, the marking point can be moved to a desired distance, such as 2 or 3 mm, away from the reference piece, which reference piece can be located against the door frame and moved therealong to allow the marking implement to create or scribe a parallel line along a door located next to the door frame. The created or scribed line on the door thus has the constant set distance from the door frame along the path of the tool.

The tool enables a user such as a carpenter to mark any gap he requires from 1 mm to 40 mm in one fitting, whereas at present it takes two or three fittings to achieve this.

The tool is designed for marking doors but can be used to mark parallel gaps for or to other items.

The present invention is not limited to doors, and also covers a hand-holdable marking tool comprising:

a housing;

a plate-like reference piece locatable against a surrounding frame; and a marking implement having a marking point movable to a pre-determined distance away from the reference piece.

The plate-like reference piece preferably has a generally or substantially flat bottom surface able to abut the sides of a door frame to allow parallel and aligned movement of the tool thereagainst.

The plate-like reference piece is preferably of a thickness suitable for insertion between a door and a frame for the door, e.g. a thickness of approximately 1 mm.

The plate-like reference piece is preferably moveable relative to the housing, more preferably moveable inwardly and outwardly from the housing, even more preferably movable in alignment with the general longitudinal axis of the door tool. Whilst being moveable, the reference piece may be securable or otherwise fixable to the housing in one or more desired positions, including one or more indexed positions. The reference piece may be movable between a storage position either wholly or substantially within the housing when not required for use, and a use position sufficiently extended from the housing for use.

The plate-like reference piece may be a single regular piece, or comprise one or more parts or portions having different shape, width or height.

The marking implement may be any implement having a fixed or separable marking point, and generally being securable to the housing. The marking implement may be separable from the housing, especially to refresh or replace the marking point.

The marking implement may be able to create a mark in or on a surface.

The marking point may be any suitable piece, item, unit, apparatus or device either being integral or separable with the marking implement, and able to provide a distinct line, usually by physical marking or scribing on/in material of the door, etc.

The door marking tool preferably includes a mechanism able to move the marking point, either directly or indirectly, and usually by movement of the marking implement, a variable and defined distance away from the reference piece, generally 'above' the reference piece when in a hand-held position. Optionally, the mechanism requires force to move the marking point from a desired or set position.

Preferably, the mechanism includes an adjuster able to be operated or controlled by the hand of a user, generally being the same hand as the hand holding the door tool. Movement and/or fixation of the adjuster may be fully in the control of the hand of a user. The adjuster may comprise any known device, unit or apparatus, preferably including at least one control wheel. More preferably, at least part of the adjuster, such as part of a control wheel, is accessible in, through or outside the housing, for adjusting the mechanism.

According to a second aspect of the present invention, there is provided a method of marking a door in comparison with a corresponding door frame comprising at least the steps of:

(a) locating the reference piece of a door marking tool as described herein against the door frame;

(b) adjusting the distance of the marking point of the door marking tool away from the reference piece;

(c) locating the marking implement of the door marking tool against the door; and (d) moving the door marking tool along the door frame such that the marking point creates a line on the door parallel to and a distance from the door frame set in step (b).

Steps (a), (b) and (c) may be carried out in any suitable order.

Figure 1B:
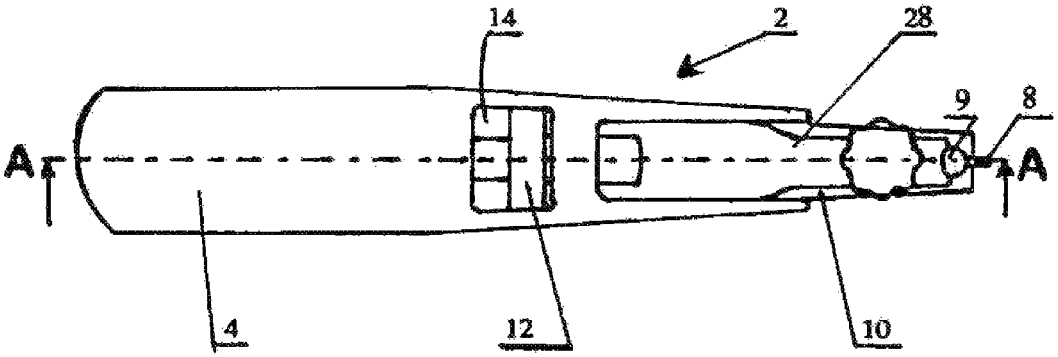
Figure 1C:
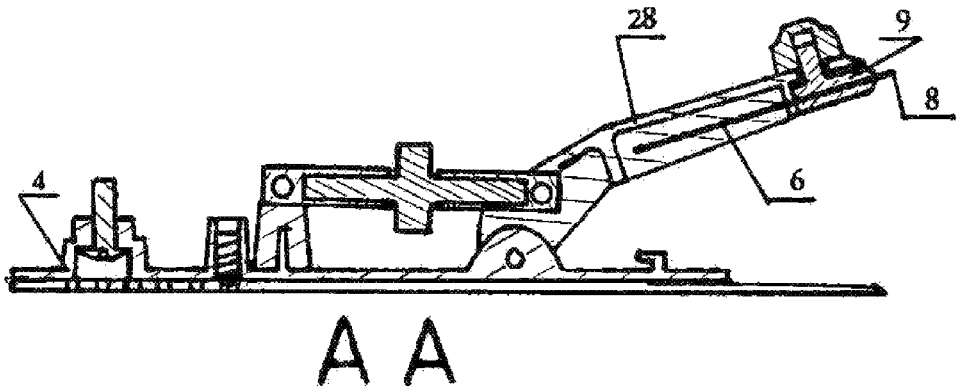

Embodiments of the present invention will now be described by way of example only and with reference to the accompanying drawings in which:

FIGS. 1*a* and 1*b* are side and plan views of a door marking tool according to one embodiment of the present invention;

FIG. 1*c* is a cross-sectional view along line AA of FIG. 1*b*, and

Figure 2:
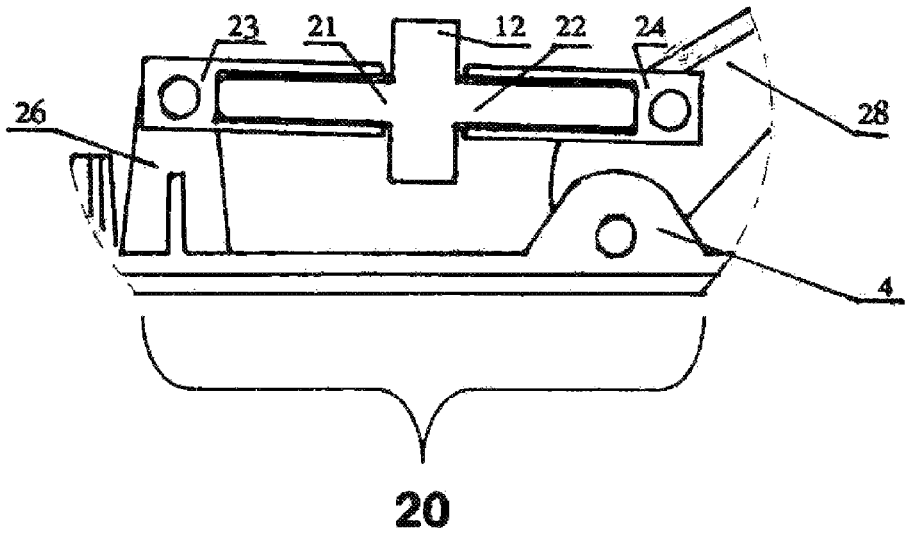
Figure 3:
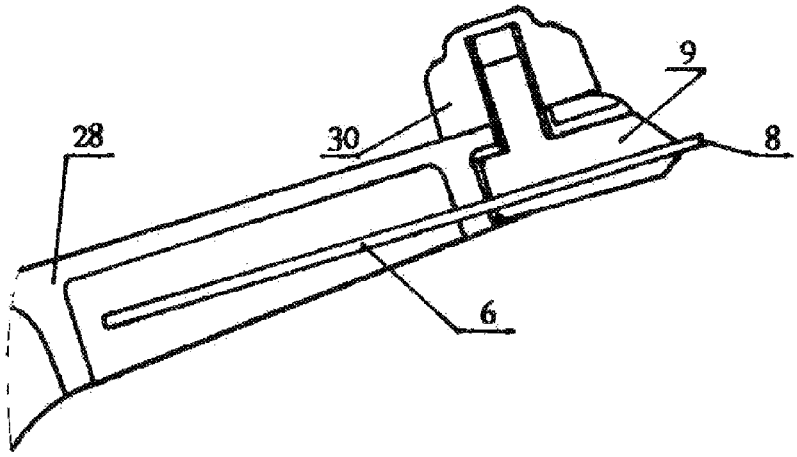
Figure 4:
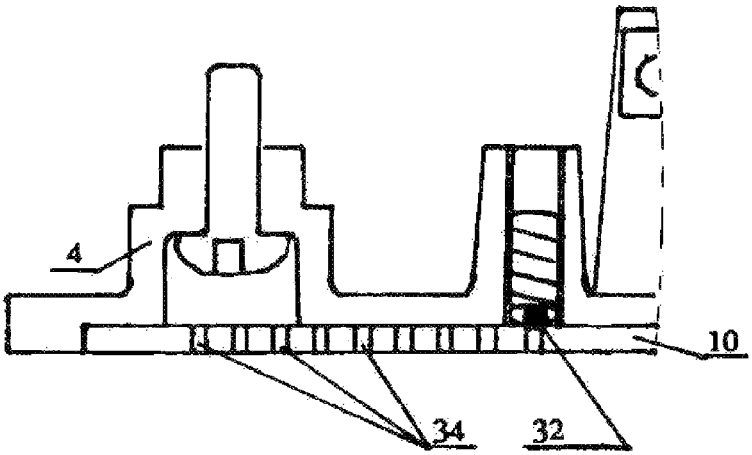

FIGS. 2, 3 and 4 are internal part-views of the door marking tool of FIG. 1.

Referring to the drawings, FIG. 1*a* shows a hand-holdable door marking tool 2 according to one embodiment of the present invention. The door marking tool 2 comprises a housing 4, an adjustable arm 28, a marking implement (not shown), having a marking point 8, a marking implement holder 9, and a plate-like reference piece 10.

FIG. 1*a* shows the housing 4 having a generally flat or planer base, and the reference piece 10 in alignment with the base of the housing 4. The reference piece 10 comprises a flat plate extendible from within the housing 4 outwardly therefrom, generally in a direction forwardly from a part of the housing 4 that could be defined as its 'front', and generally in alignment with the marking mechanism.

FIGS. 1*a-b* also show a wheel control 12 having a portion accessible through an aperture 14 in the housing 4 as described hereinbelow.

FIG. 1*c* shows a section through FIG. 1*b* on the section line AA with the main cover of the housing removed therefrom. The marking implement 6 is held within the adjustable arm 28 by the marking implement holder 9, leaving a marking point 8 extending from the tool when in use. The adjustable arm 28 is pivotal to the housing 4.

FIG. 2 shows a partial internal view of the door marking tool 2 with the main cover of the housing 4 removed therefrom. FIG. 2 shows a mechanism 20 comprising the wheel control 12 with threaded shafts 21, 22 extending from opposite sides thereof. The shaft 21 is screwed into a first support piece 23, which is pivotally connected to a pillar 26. The shaft 22 is screwed into a second support piece 24, which is pivotally connected to the adjustable arm 28.

As shown in FIG. 3, the adjustable arm 28 includes a fixing piece 30, generally being a thumbscrew nut locatable on a suitable thread of the marking implement holder 9, which can fix the marking implement 6 to the holder 9. Movement of the fixing piece 30 allows separation of the marking implement 6 from the holder 9, such as for refreshing of the marking point 8, either by extending thereof or replacement of the marking point 8, or the marking implement itself. The marking implement 6 may be a lead, having a marking point 8 being formed of the lead. Alternatively, the marking implement 6 may comprise a metallic piece, for scribing in a surface of the door.

Returning to FIG. 2, rotation of the wheel controller 12 rotates the threaded shafts 21, 22, and causes the distance between the support pieces 23, 24 to vary. As this distance varies, the adjustable arm 28 pivots with respect to the housing 4, so as to change the height of the marking point 8 above or away from the reference piece 10. In this way, rotation of the wheel control 12 by a part of a hand of a user, such as a finger or palm is possible to vary the distance between the reference piece 10 and the marking point 8.

Preferably, but not essentially, the door tool 2 includes a scale or another measurement definition able to indicate to the user either directly or indirectly the distance between the reference piece 10 and the marking point 8. Such distance will generally take into account the thickness of the reference piece 10, such that the distance of the marking point 8 is calculated to be from the door frame side taking into account the thickness of the reference piece 10.

FIG. 4 shows a pin 32 able to be located in a series of holes 34 provided in the reference piece 10 within the housing 4. The pin 32 may be biased to a position within one of the holes 34, such that positive action is required by a user to withdraw the pin 32 for movement of the reference piece 10 and relocation of the pin 32 in a different hole 34 to secure the reference piece 10 at a different extension beyond the housing 4. Thus, a user is able to extend the reference piece 10 to a different distance for different uses, and/or to minimize the extent of the reference piece 10 outside the housing 4 when the door tool 2 is not in use.

The present invention is not limited to the marking of doors, and may be used to mark or scribe lines for the location of other pieces, units, apparatus or devices within an aperture, optionally having a frame therearound, such as windows, hatches and the like. The marking tool is capable of butting to an uneven or off parallel surface. Thus, whilst the present invention is described in relation to being a "door marking tool", its use is not limited to doors.

The present invention provides a simple tool able to allow a user to mark an accurate line on a door or the like to be located within a frame or the like having a defined distance therebetween, which distance can be varied for different sides or varied along the same side if required. The user only requires one hand for such marking, leaving one hand free for the location of the door within the frame.

In particular, having a thin plate-like reference guide that moves in and out from the tool also allows all adjustments to the tool to be done with one hand.

Various modifications and variations to the described embodiments of the invention will be apparent within the art without the parting of the scope of the invention testifying herein. Although the invention has been described in connection with specific preferred embodiments it should be understood that the invention as defined herein should not be unduly limited to such specific embodiment.

The invention claimed is:

1. A hand-holdable door marking tool comprising:

a housing;

a plate-like reference piece having a first end attached to the housing and a second end opposite the first end, the second end being linearly extendable away from the housing and locatable against a door frame; and an arm having a first end pivotally attached to the housing and a second end with a marking implement having a marking point movable relative to the reference piece;

an adjustment mechanism attached to the housing and pivotally attached to the arm and configured to provide a set position for the arm relative to the housing, the adjustment mechanism also configured to allow a user to manually adjust the set position of the arm relative to the housing thereby changing the distance between the marking point and the second end of the reference piece.

2. A tool according to claim 1 in which the reference piece is a plate having a substantially flat bottom surface able to abut the sides of a door frame to allow parallel and aligned movement of the tool thereagainst.

3. A tool according to claim 1 in which the reference piece is moveable inwardly and outwardly from the housing.

4. A tool according to claim 3 in which whilst being moveable, the reference piece is securable to the housing in one or more desired positions, including one or more indexed positions.

5. A tool according to claim 3 in which the reference piece is movable between a storage position at least substantially within the housing when not required for use, and a use position sufficiently extended from the housing for use.

6. A tool according to claim 1 in which the marking implement is any implement having a fixed or separable marking point, and being securable to the arm.

7. A tool according to claim 1 in which the marking implement is separable from the arm, to refresh or replace the marking point.

8. A tool according to claim 1 in which the marking point is any suitable piece, item, unit, apparatus or device either being integral or separable with the marking implement, and able to provide a distinct line in material of the door.

9. A tool according to claim 1 in which the adjustment mechanism requires force to move the arm from a set position.

10. A tool according to claim 1 in which the adjustment mechanism includes an adjuster able to be operated by a hand of a user being the same hand as the hand holding the door tool.

11. A tool according to claim 10 in which the adjuster comprises at least one control wheel.

12. A tool according to claim 11 in which a part of the control wheel is accessible in, through or outside the housing, for adjusting the mechanism.

13. A method of marking a door in comparison with a corresponding door frame comprising at least the steps of:

(a) locating a plate-like reference piece of a door marking tool against the door frame, the door marking tool comprising:

a housing;

a plate-like reference piece having a first end attached to the housing and a second end opposite the first end, the second end being locatable against a door frame; and an arm having a first end pivotally attached to the housing and a second end holding a marking implement having a marking point, the arm being movable relative to the reference piece;

an adjustment mechanism attached to the housing and pivotally attached to the marking implement and configured to provide a set position for the marking implement relative to the housing, the adjustment mechanism also configured to allow a user to manually adjust the set position of the marking implement relative to the housing thereby changing the distance between the marking point and the second end of the reference piece;

(b) adjusting the distance of the marking point of the door marking tool away from the reference piece;

(c) locating the marking point against the door; and (d) moving the door marking tool along the door frame such that the marking point creates a line on the door parallel to and a distance from the door frame set in step (a).

14. A hand-holdable marking tool comprising:

a housing;

a reference piece having a first end attached to the housing and a second end opposite the first end, the second end being linearly extendable away from the housing and configured to be locatable against a door frame; and an arm having a first end pivotally attached to the housing and a second end holding a marking implement having a marking point, the arm being movable to adjust the distance between the reference piece and the marking point;

an adjustment mechanism configured to allow a user to manually adjust the position of the arm relative to the housing thereby changing the distance between the marking point and the second end of the reference piece, the adjustment mechanism having a wheel affixed to a threaded shaft, the threaded shaft being rotatable within a first support piece and a second support piece, the first support piece being attached to a pillar attached to the housing and the second support piece being pivotally attached to the arm.

15. A tool according to claim 14, wherein the reference piece is securable to the housing in one or more desired positions so that the second end may be set at different linear distances from the housing.

16. A tool according to claim 14, wherein at least one of the housing and the reference piece has a substantially flat bottom portion.

17. A tool according to claim 14, wherein the arm is provided with a holder and a fixing piece to detachably secure the marking implement to the holder.

18. A tool according to claim 14, wherein the housing substantially covers the adjustment mechanism except for the wheel.

* * * * *